United States Patent [19]

Korte

[11] Patent Number: 4,512,478

[45] Date of Patent: Apr. 23, 1985

[54] PAPERBOARD CARTON WITH IMPROVED PERFORATED OPENING AND METHOD OF MAKING SAME

[75] Inventor: Ralph J. Korte, Darien, Ill.

[73] Assignee: Champion International Corporation, Stamford, Conn.

[21] Appl. No.: 429,802

[22] Filed: Sep. 30, 1982

[51] Int. Cl.[3] ..... B65D 5/72

[52] U.S. Cl. ..... 206/611; 206/628; 427/289

[58] Field of Search ..... 206/604, 605, 608, 611, 206/614, 615, 620, 622, 625, 630, 634, 494, 613, 628; 229/17 S, 17 R, 17 G; 221/33, 45, 63, 302; 428/43; 427/285, 289

[56] References Cited

U.S. PATENT DOCUMENTS

| | | | |
|---|---|---|---|
| 3,148,824 | 9/1964 | Foster et al. | 206/608 X |
| 3,207,417 | 9/1965 | Hennessey et al. | 206/613 X |
| 3,257,028 | 6/1966 | Metzger | 221/63 |
| 3,366,269 | 1/1968 | Slomski | 206/608 X |
| 3,479,203 | 11/1969 | Broadhurst | 427/289 |
| 3,620,438 | 11/1971 | Wood et al. | 206/611 |
| 3,773,248 | 11/1973 | Cecil et al. | 206/613 X |
| 3,918,608 | 11/1975 | Faller | 221/63 |
| 4,212,395 | 7/1980 | Korte | 206/611 |
| 4,218,497 | 8/1980 | Stringham et al. | 427/289 |
| 4,354,890 | 10/1982 | Maffey | 427/289 |

*Primary Examiner*—Allan N. Shoap
*Assistant Examiner*—Bryon Gehman
*Attorney, Agent, or Firm*—Evelyn M. Sommer; John H. Mulholland; William W. Jones

[57] ABSTRACT

A paperboard container is provided having an opening member defined by an array of perforations. A coating of plastically deformable and readily rupturable material is disposed on the inside surface of the container and extends on each side of each perforation in the array of perforations including the continuous section of paperboard material between adjacent perforations. The cooperation of the coating of plastically deformable material and the paperboard material ensures that the severances between adjacent perforations will be more precise, less ragged and will not produce detached slivers of paperboard material.

10 Claims, 3 Drawing Figures

PAPERBOARD CARTON WITH IMPROVED PERFORATED OPENING AND METHOD OF MAKING SAME

BACKGROUND OF THE INVENTION

The subject invention relates to paperboard containers, and specifically to paperboard cartons having opening members defined by perforations. As an example, the subject invention may be used in boxes to store and dispense facial tissues. Of course, as will be evidenced from the following description, the subject invention is not so limited, and can be incorporated into any paperboard structure having an opening member defined by perforations.

Generally, the area of the paperboard container to be opened is outlined by an array of perforations. More particularly, each perforation comprises a single die-cut which extends entirely through the paperboard material. The individual die-cuts typically are separated from one another by relatively short sections of continuous, non-cut paperboard material which function to keep the opening member engaged to the remainder of the container prior to opening. These continuous sections must be strong enough to keep the opening member and the remainder of the container intact during packaging, shipping and storage. However, the array of perforations must be such that the opening member can be easily and precisely separated from the remainder of the container by the user.

The opening member typically includes a starting point or tab at which the user of the container initially exerts a force to separate the opening member from the remainder of the container. In many paperboard containers, the starting point will define a pull tab. Beginning at this starting point, the user exerts a force in an appropriate direction so as to tear the continuous sections intermediate adjacent perforations. The array of perforations on the container is such that the continuous sections intermediate adjacent perforations will tear in a predictable manner, thus effecting the desired separation of the opening member from the remainder of the container.

Paperboard containers made according to known designs include many distinct arrangements of perforations. However, in many prior art containers, the sections which are torn between two adjacent perforations define ragged edges. Additionally, the tearing action often will cause fibers of the paperboard material from which the prior art containers are constructed to become separated from the body of paperboard material. Furthermore, the tearing action frequently causes delamination of certain layered paperboard structures and can cause unintended tears outside the area defined by the array of perforations. The ragged edges resulting in opening many prior art paperboard containers often make the removal of material from the paperboard container difficult. In particular, in prior art paperboard containers used for storing facial tissues or other products made from thin sheets of fragile material, the ragged edges are known to catch the stored items as they are being removed from the container. This can result in a tearing of the tissues, or other similar material stored in the prior art paperboard container. The disengaged fibers of paperboard material that often are generated in opening many prior art paperboard containers frequently present an undesirable aesthetic or hygenic condition. For example, the user of facial tissues generally would find slivers of fibrous paperboard material aesthetically undesirable if not unacceptable. Similarly, these slivers of material may be hygenically unacceptable on prior art paperboard containers used with food products.

U.S. Letters Pat. No. 4,212,395, entitled MULTI-ANGLED PERFORATED OPENING DEVICE which issued to Ralph J. Korte on July 15, 1980 and which is assigned to the assignee of the subject application is directed to an improved arrangement of perforations in a paperboard container which substantially reduces the degree to which the torn edges of a perforated opening remain ragged, and similarly, reduces the likelihood of fibrous members being separated at the torn edges. The disclosure of U.S. Pat. No. 4,212,395 is incorporated herein by reference. Specifically, the perforations which define the opening member in the paperboard container of U.S. Pat. No. 4,212,395 form a symmetrical curvilinear outline. This curvilinear outline comprises a plurality of associated pairs of arcuate segments, with the segments of each pair being disposed in a mirror image arrangement on opposite sides of the axis of symmetry. All of the perforations of a segment are disposed at substantially the same predetermined angle with respect to the axis of symmetry of the outline. However, the perforations of one segment are disposed in a different angle with respect to that axis than the perforations of at least one of the segments immediately adjacent thereto. Additionally, the perforations of each segment of an associated pair of segments is disposed at an angle relative to the axis of symmetry which is the mirror image of the angle of the perforations of the other segment of the associated pair. This arrangement, as explained in U.S. Pat. No. 4,212,395 provides ease of tearing plus strength against accidental collapse during packing, handling, shipping, or storing of the paperboard container. Furthermore, the arrangement of perforations in the paperboard container of U.S. Pat. No. 4,212,395 reduces the raggedness of the torn edges and minimizes the degree to which fibrous material will become separated from the torn edges of the container. Reference is made to U.S. Letters Pat. No. 4,218,497 entitled "METHOD FOR DIE CUTTING A PLASTIC WEB" and assigned to the assignee of the subject invention. In U.S. Letters Pat. No. 4,218,497 a frangible but non-splintering coating is applied to a web to prevent hair-like slivers on a cut edge.

The multi-angled perforated opening disclosed in the paperboard container of U.S. Pat. No. 4,212 395 has been found to be extremely desirable and effective. However, it has been found desirable to develop a paperboard container with a perforated opening having even further improvements.

Accordingly, it is an object of the subject invention to provide a paperboard container having an opening member defined by an array of perforations such that the edges formed by the tears between adjacent perforations when the container is opened will be less ragged than in known containers.

It is another object of the subject invention to provide a paperboard container having an opening member defined by an array of perforations that will further reduce the possibility of fibrous material becoming separated from the paperboard material as the paperboard container is being opened.

It is a further object of the subject invention to provide a paperboard container having an opening member that will minimize the possibility of inadvertent tears of the paperboard material while the subject paperboard container is being opened.

It is still an additional object of the subject invention to provide paperboard containers with an array of perforations defining an opening member and with a strip of coating material to inhibit uneven tearing of the paperboard sections between adjacent perforations.

SUMMARY OF THE INVENTION

In accordance with the above recited objectives, the subject invention provides a paperboard container with a new and improved perforated opening. More particularly, a strip of coating of plastically deformable material is applied adjacent the perforations in the paperboard material on the surface thereof that will define the inside of the container. The coating of plastically deformable material may be a varnish, lacquer or polyurethane coating. The coating is applied to the paperboard material in liquid flowable form by a roller or any other known printing technique. Preferably, the coating material has fast drying characteristics. As the coating material is applied, it partially penetrates the fibrous paperboard material, and as it dries, it is firmly secured to the paperboard material. However, even after drying, the coating material retains its ability to be slightly plastically deformed when a tensile force is exerted upon it. The coating is applied prior to the die-cutting of the perforations. Additionally, the coating material is applied to at least the continuous sections between adjacent perforations, and preferably is applied so as to define a continuous strip across the intended area to be separated.

The coating is of a plastically deformable and readily ruputurable material such as varnish, lacquer, polyurethane, or the like which performs several functions. First, the coating partially penetrates the surface of the paperboard material and adheres firmly to the surface to which it is applied. As a result, as the continuous sections between adjacent perforations are torn to define severance lines, the fibers of paperboard material at the severance line will tend to be adhered to the coating. Consequently, there is a substantially reduced probability of having paperboard particles becoming disengaged during the tearing. Second, because of the different elastic characteristics of the paperboard material and the coating, the paperboard material will at least begin to tear prior to the rupturing of coating. More specifically, the coating material will plastically deform to a greater degree than the paperboard material. Thus, there will be a continuous connection of coating material across both sides of the severance line between adjacent perforations after the initial severance of the paperboard material. This continuous connection plus the partial penetration of the coating material supports the adjacent surface of the paperboard material. In so doing the coating inhibits delamination, and causes the severance to be along a line that more closely approximates a perpendicular to the plane of the paperboard material. As a result, the severance tends to be neater and less ragged. Third, by reducing the tendency of a tear along lines that are not perpendicular to the plane of the paperboard material, the probability of having a tearing of paperboard material substantially outside the outline defined by the array of perforations is substantially eliminated for most configurations of array of perforations. Another benefit is that achieved by the addition of the coating to the backside or reverse side from the die cutting of the paperboard. This allows the dies, that can only penetrate up to 100% or less because of the back-up of steel plates, to penetrate virtually 100% through the paper fibers of the paperboard. This allows the die to penetrate through the fibers to allow the coating of varnish or similar readily rupturable material to rupture more readily and not have partial cuts that, in the prior paperboard art, caused much of the delamination and unnecessary fuzz or paper fibers.

DESCRIPTION OF THE PREFERRED EMBODIMENT

Figure 1:
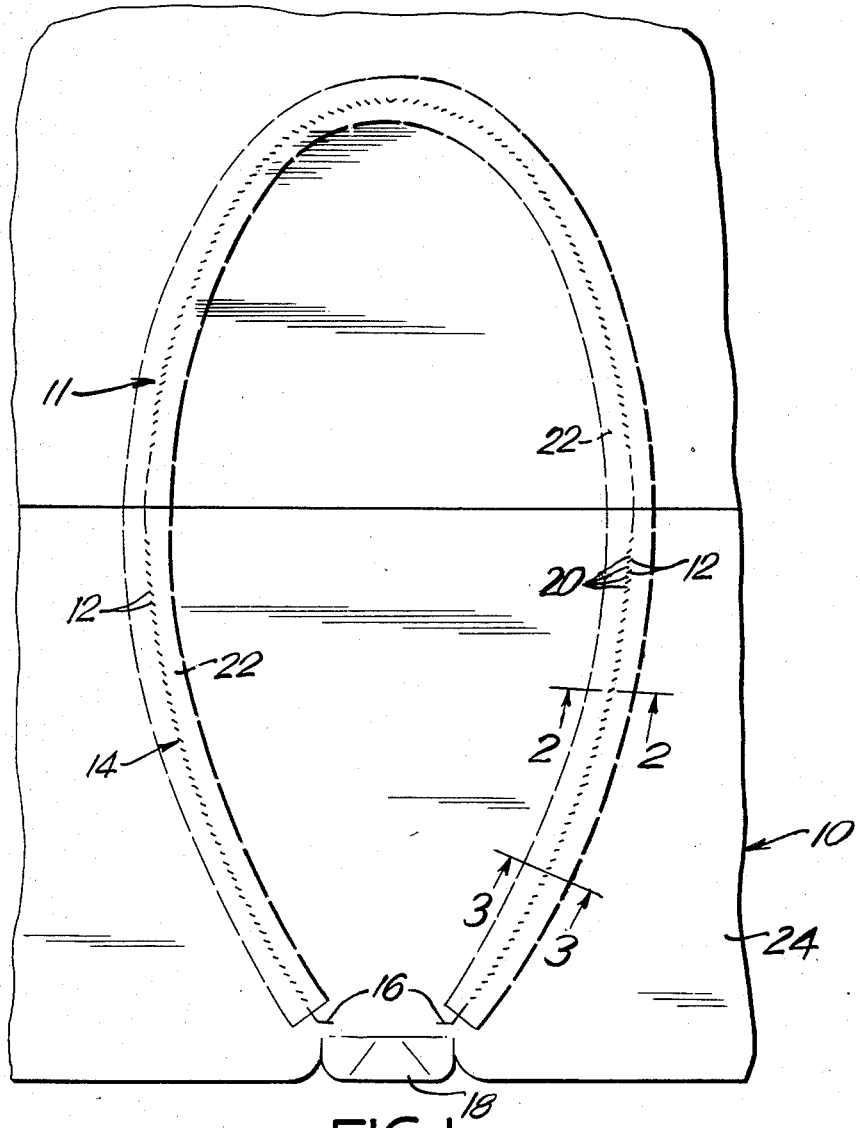
FIG. 1 is a plan view of a paperboard blank showing the surface that defines the outside of a paperboard container erected from the blank, and showing in phantom lines the strip of plastically deformable material disposed on the opposed surface.

FIG. 1 shows paperboard material 10 which represents a portion of a blank from which a paperboard carton is erected. A plurality of individual perforations 12 are arranged to define an array of perforations 14. As depicted in FIG. 1, the array 14 of perforations 12 comprises several arcuate sections arranged into a symmetrical configuration. However, it should be emphasized that the invention described herein is equally adaptable to virtually any configuration of perforations.

The arcuate array 14 of perforations 12 shown in FIG. 1 has opposed end points 16 which are disposed on paperboard material 10 adjacent tab 18. The user typically will grasp tab 18, and subsequently urge tab 18 away from the plane of paperboard material 10. The force exerted on tab 18 will cause corresponding forces to be exerted on continuous sections 20 of paperboard material intermediate adjacent perforations 12. This force will cause the sequential tearing of continuous sections 20 beginning with continuous sections 20 nearest tab 18 and proceeding away therefrom. In this manner, the entire opening member 11 will be lifted out of the plane defined by paperboard material 10.

A strip 22 of plastically deformable and readily rupturable material is applied to paperboard material 10 in flowable form and is allowed to dry thereon. The strip 22 entirely coats the continuous sections 20 between adjacent perforations 12, and extends approximately one half inch on each side of each perforation 12. The material of strip 22 can be any polyurethane, varnish, lacquer or ink that will adhere firmly to the paperboard material and will penetrate slightly into the paperboard material. Any of the above cited materials for strip 22 will plastically deform beyond the tearing point of the paperboard material 10. Strip 22 may be applied to the paperboard section 10 by any of a variety of known printing techniques such as a roller application.

Figure 2:
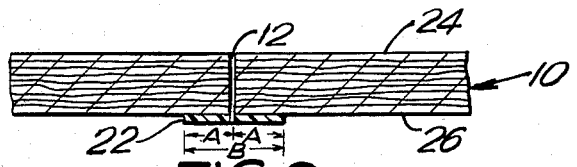
FIG. 2 is a cross-sectional view taken along line 2—2 of FIG. 1.
Figure 3:
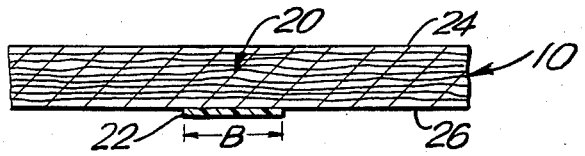
FIG. 3 is a cross-sectional view taken along line 3—3 of FIG. 1.

FIGS. 2 and 3 illustrate that the paperboard material 10 includes an upper surface 24 and a lower surface 26. Upper surface 24 generally would be the smooth finished surface of paperboard material 10 upon which indicia would be printed to describe the contents and brand of the material to be included in the container constructed from paperboard material 10. Strip 22 is coated onto and thus fixedly secured to lower surface 26 of paperboard material 10. Thus, in the arrangement shown in FIGS. 1 through 3, the indicia and the strip 22 are entirely independent of one another. Additionally, the unfinished lower surface 26 allows for better penetration of strip 22 into paperboard material 10.

Referring to FIG. 2, each perforation 12 extends entirely through paperboard material 10 plus through strip 22. Dimension "A" corresponds to the distance from each perforation 12 to the edge of strip 22. As mentioned above, in the typical application, "A" would equal approximately one half inch. Dimension "B" corresponds to the entire width of strip 22, and typically would equal one inch. Returning to FIG. 3, it is shown that the portions of strip 22 between adjacent perforations also has a width corresponding to dimension "B", which equals approximately one inch. Thus, strip 22 is of substantially constant width along the array of perforations thereby facilitating its application.

The desired thickness of strip 22 would be a function of the material from which strip 22 is comprised as well as the thickness and type of paperboard material employed. Specifically, strip 22 must be of sufficient thickness to ensure that it will plastically yield up to at least the point of tearing of the paperboard material 10. However, strip 22 must not be so elastic that it stretches significantly beyond the tearing of paperboard material 10. Typically, the coating would be approximately 0.0005 inches on a fibrous paperboard of a thickness up to 0.040 inches.

As mentioned above, the cooperation between paperboard material 10 and strip 22 accomplishes several significant functions. First, strip 22 will ensure that the severance of paperboard material 10 between adjacent perforations 12 will be more nearly perpendicular to the plane of paperboard material 10. More specifically, strip 22 permanently coats and partially penetrates paperboard material 10. This coating and penetration of strip 22 tends to support lower surface 26, and thereby inhibits non-perpendicular tearing or delamination of paperboard material 10 when opening member 11 is being separated from the remainder of paperboard material 10. By inhibiting this angular tearing and delamination a less ragged more precise severance is provided that is less likely to snag the material being removed from the carton that is erected from paperboard material 10. Additionally, by avoiding angular tears and delamination the possibility of having a tear that departs from the configuration of the array 14 of perforations 12 is substantially reduced. Second, by initially yielding in response to the forces exerted upon paperboard material 10, strip 22 remains continuous and in contact with opposed edges at each severance between adjacent perforations 12. This continuous contact of strip 22 with paperboard material 10 during tearing virtually eliminates the possibility of fibrous slivers becoming disengaged at the severed edge.

In summary, the subject invention provides a perforated paperboard material for forming a container on which a coating of plastically deformable material is disposed. The coating of plastically deformable material preferably extends about one half inch from each side of each perforation, including the non-perforated continuous sections between adjacent perforations. The coating of plastically deformable material is applied by any known technique so that it permanently coats and partially penetrates into the paperboard material. The coating of plastically deformable material is applied to a thickness such that it will be plastically stretched up to the point of tearing of the paperboard material, and subsequently will itself become severed. This coating preferably is applied to the surface of paperboard material that will define the inside of the container. This structure virtually assures non-ragged precise severances without the production of undesired slivers of paperboard material.

While the preferred embodiment of the subject invention has been described and illustrated, it is obvious that various changes and modifications can be made therein without departing from the spirit of the present invention which should be limited only by the scope of the claims.

What is claimed is:

1. A blank of fibrous paperboard material for forming a container, said blank including opposed first and second surfaces, the first surface being a printed indicia bearing surface for defining the outside of said container, the second surface for defining the opposed inside of said container, said blank including an opening member defined by an array of spaced die-cut perforations, said blank including a coating of plastically deformable material disposed on and partially penetrating into the second surface of said blank, said coating defining a continuous strip extending along and to each side of said array of perforations, each said die cut perforation extending entirely through said blank and through said coating, whereby when said blank is erected to form a container and when a force is exerted on said opening member to remove said opening member from said container, said coating being of a plastically deformable and readily rupturable material inhibits uneven tearing of the opening member and said fibrous paperboard material and further inhibits disengagement of slivers of fibrous paperboard material therefrom.

2. A blank as in claim 1 wherein said strip of coating extends approximately one-half inch to each side of said array of perforations.

3. A blank as in claim 1 wherein said coating comprises a material that will plastically deform to a point beyond the tearing point of said planar sheet of fibrous paperboard material.

4. A blank as in claim 1 wherein said coating comprises a plastic material.

5. A blank as in claim 1 wherein said coating is a polyurethane material.

6. A blank as in claim 1 wherein said coating is a varnish, lacquer or ink.

7. A method for producing a paperboard container having an improved removable opening member, said method comprising the steps of:

providing a planar sheet of fibrous paperboard material;

coating one surface of said planar sheet with a continuous strip of flowable material which when dried is plastically deformable and readily rupturable, said strip being coated conforming generally to the size, configuration and location of the opening member;

allowing said flowable material to partially penetrate said planar sheet of fibrous paperboard material and dry thereon to define a coating of plastically deformable material;

die-cutting an array of perforations through said planar sheet of fibrous paperboard material and through said strip of coating to define said opening member; and forming said container from said planar sheet of fibrous paperboard material.

8. A method as in claim 7 wherein said coating is applied to define a strip of material extending approximately one-half inch to each side of said array.

9. A method as in claim 7 wherein said coating is applied with a roller.

10. A method as in claim 7 wherein said coating is printed onto said planar sheet of fibrous paperboard material.

* * * * *